US005944118A

United States Patent [19]

Johansson et al.

[11] Patent Number: 5,944,118

[45] Date of Patent: Aug. 31, 1999

[54] PNEUMATIC IMPACT BREAKER

[75] Inventors: Ingemar Sven Johansson, Haninge; Ake Lennart Nilsson, Enskede, both of Sweden

[73] Assignee: Atlas Copco Berema AB, Nacka, Sweden

[21] Appl. No.: 08/700,528

[22] PCT Filed: Feb. 28, 1995

[86] PCT No.: PCT/SE95/00209

§ 371 Date: Feb. 10, 1997

§ 102(e) Date: Feb. 10, 1997

[87] PCT Pub. No.: WO95/23051

PCT Pub. Date: Aug. 31, 1995

[30] Foreign Application Priority Data

Feb. 28, 1994 [SE] Sweden ..... 9400684

[51] Int. Cl.[6] ..... B25D 9/04

[52] U.S. Cl. ..... 173/128; 173/212; 173/135; 173/DIG. 2

[58] Field of Search ..... 173/210, 212, 173/128, 135, 138, DIG. 2, 206

[56] References Cited

U.S. PATENT DOCUMENTS

| | | | |
|---|---|---|---|
| 777,368 | 12/1904 | Clossey | 173/122 |
| 2,290,256 | 7/1942 | Souter | 173/121 |
| 3,042,004 | 7/1962 | Fischer | 227/147 |
| 3,179,185 | 4/1965 | O'Farrell | 173/133 |
| 3,263,770 | 8/1966 | Alm | 181/230 |
| 3,356,166 | 12/1967 | Diachenko | 173/212 |
| 3,451,492 | 6/1969 | Ekström et al. | 173/162.2 |
| 3,554,316 | 1/1971 | Judd | 173/DIG. 2 |
| 3,727,700 | 4/1973 | Amtsberg | 173/212 |
| 3,939,925 | 2/1976 | Danielson | 173/170 |
| 4,018,291 | 4/1977 | Anderson | 173/135 |
| 4,189,917 | 2/1980 | Gunning | 173/DIG. 2 |
| 4,303,131 | 12/1981 | Clark | 173/134 |
| 5,419,403 | 5/1995 | Klemm | 173/206 |
| 5,749,421 | 5/1998 | Johansson | 173/162.2 |

*Primary Examiner*—Peter Vo
*Assistant Examiner*—James P. Calve
*Attorney, Agent, or Firm*—Frishauf, Holtz, Goodman, Langer & Chick, P.C.

[57] ABSTRACT

A pneumatic impact breaker comprises a housing (11) with a cylinder bore (20), a hammer piston (28) with a piston head (63) and an impact delivering stem portion (64), an anvil (14) displaceably supported in a cylinder bore extension (50) and normally abutting against the shank (15) of a working implement (16), an annular energy absorbing air cushion chamber (59) is formed between the hammer piston (28), the cylinder bore (20) and an annular shoulder (49) in the cylinder bore (20), wherein the piston head (63) is formed with two axially spaced end portions (65, 66) for guiding and sealing cooperation with the cylinder bore (20). The length of the piston head (63) is considerably larger than the length of the stem portion (64), and the radial play between each one of the end portions (65, 66) and the cylinder bore (20) is smaller than the play between the stem portion (64) and the cylinder bore extension (50),whereby is guaranteed a non-metallic yet effective sealing cooperation between the stem portion (64) and the cylinder bore extension (50) and an improved tightness of the energy absorbing air cushion chamber (59).

3 Claims, 3 Drawing Sheets

PNEUMATIC IMPACT BREAKER

This invention relates to a pneumatic impact breaker of the type comprising a housing with a cylinder bore, a hammer piston reciprocable in the cylinder bore, a rear cylinder head with an air distributing valve for directing motive pressure air to alternative ends of the hammer piston to reciprocate the latter in the cylinder bore, a front portion attached to the housing and forming a guide and support means for a working implement, and a forwardly directed cylinder bore extension coaxial with and having a smaller diameter than the cylinder bore. The cylinder bore extension is separated from the cylinder bore by an annular shoulder, and an anvil is sealingly guided in the cylinder bore extension. The anvil has a forward end normally abutting the rear end of the working implement and a rear end normally located within said cylinder bore extension. The hammer piston is formed with a piston head for sealing and guiding cooperation with the cylinder bore, and a forwardly extending stem portion for cyclical penetration into the cylinder bore extension to deliver repeated impacts to the anvil at reciprocation of the hammer piston, whereby the stem portion and the piston head form together with the cylinder bore and the annular shoulder an annular energy absorbing air cushion chamber.

BACKGROUND OF THE INVENTION

Pneumatic impact breakers of the above type provide an effective breaking by a high impact energy but generate at the same time external vibrations and internal blows which have a detrimental influence on the operator as well as on the mechanical parts. Detrimental blows or so called bottom blows of the hammer piston occur as the application or feeding force on the breaker is very low, nill or negative. A negative feeding force is accomplished as the breaker is lifted up, for instance when the working implement has become jammed.

In previous impact breakers of the above type, these bottom blows have been difficult to dampen out fully, and, in order to make the parts withstand the stress forces and to ensure a safe assemblage of the breaker, the parts thereof, including the housing itself, have to be oversized. It has also been necessary to use extra strong tie bolts and/or threaded joints to keep the parts safely together. An example thereon is shown in U.S. Pat. No. 3,179,185, FIG. 4, in which the damping means for absorbing the hammer piston energy at bottom strokes comprises an annular elastomer element. In practice, this known arrangement has no ability to absorb the kinetic energy of the hammer piston, and moreover, the service life of this impact damping elastomer element will be very short.

Another example is shown in U.S. Pat. No. 3,451,492. The impact breaker illustrated therein comprises a hammer piston which has a comparatively long impact delivering stem portion in relation to the length of the piston head. This means that, due to the inevitable tilting of the piston occurring when the stem portion is out of guiding engagement with the forward small diameter cylinder bore extension, there must be provided a relatively large play between the stem portion and the bore to avoid too a violent metallic contact therebetween. This results in a relatively wide leak gap around the stem portion, and, accordingly, a rather ineffective damping volume entrapped between the hammer piston, the cylinder bore and the forward shoulder in the cylinder bore. Despite a rather large play between the piston stem and the cylinder bore extension and a following poor air volume energy absorption, there is an undesirably severe wear of the piston stem and the cylinder bore extension due to metallic contact therebetween.

OBJECT OF THE INVENTION

The main object of the invention is to accomplish a pneumatic impact breaker having an improved air cushion energy absorption at noload or bottom strokes of the hammer piston by means of an improved, more accurate rectilinear movement of the hammer piston stem portion.

Another object of the invention is to reduce the detrimental energy absorbing air volume entrapped between the hammer piston stem portion and the anvil. If the peak pressure in this air volume is allowed to be too high there will be a substantial loss in energy transfer between the hammer piston and the anvil. This problem is emphasized in impact mechanisms having a narrow leak gap, i.e. a tight fit between the piston stem portion and the bore. This problem, however, is solved by the invention.

BRIEF DESCRIPTION OF THE DRAWINGS

A preferred embodiment of the invention is described below with reference to the accompanying drawings.

In the drawings.

DETAILED DESCRIPTION

Figure 1A:
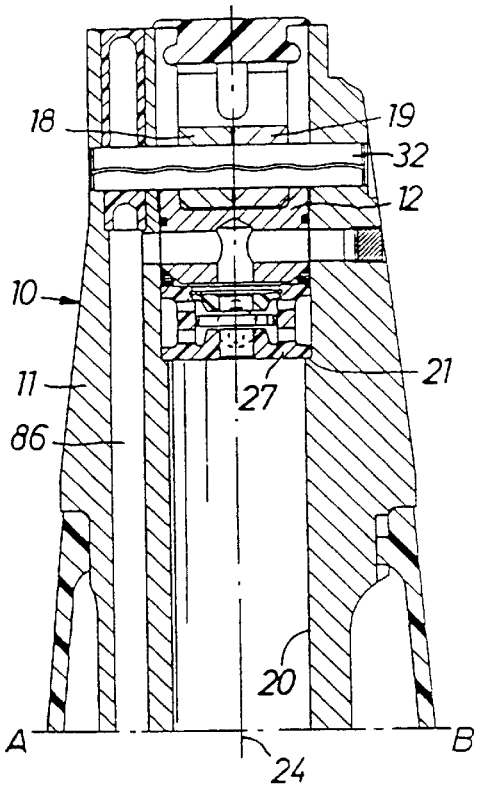
FIGS. 1A and 1B show longitudinal sections, divided by a transverse line A—B, through a pneumatic breaker according to the invention.
Figure 1B:
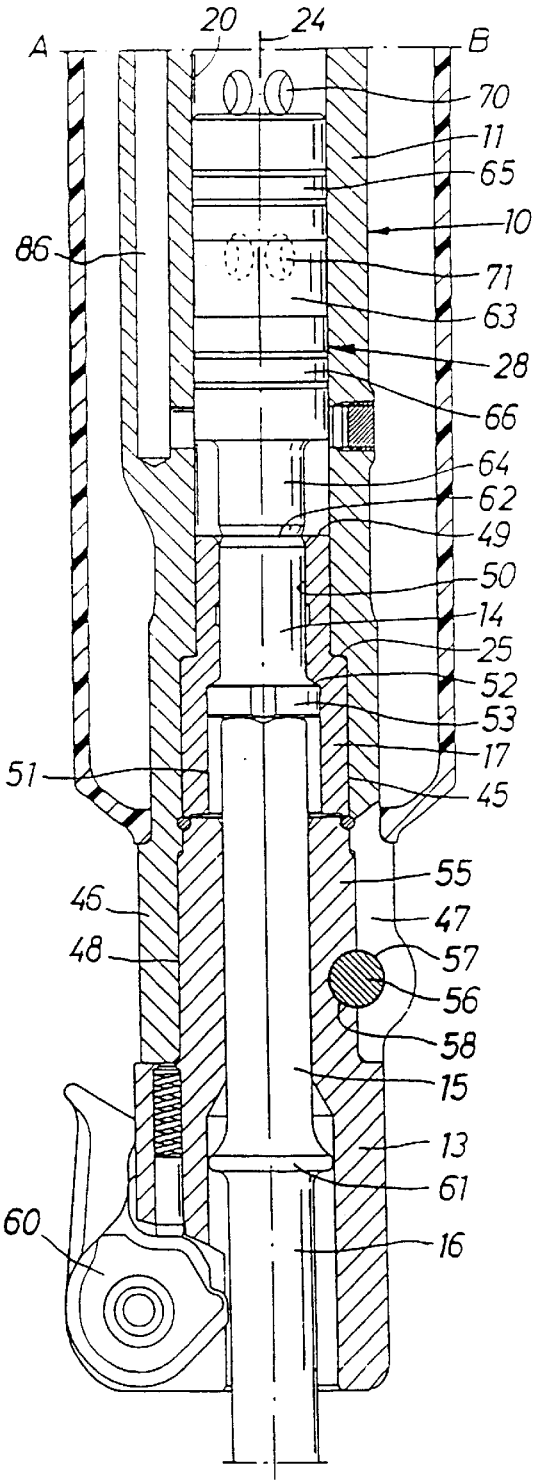
Figure 5:
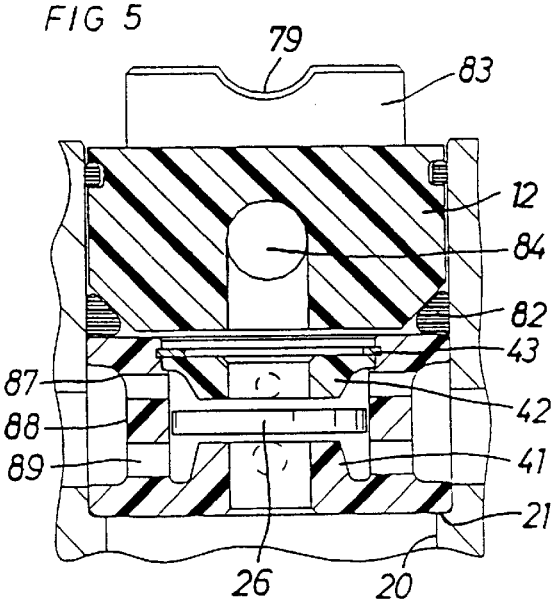
FIG. 5 shows on a larger scale a detail view of the device in FIG. 3.

The impact breaker 10 shown in FIGS. 1A, 1B comprises an elongate housing 11 with a cylinder bore 20 and provided with a cylinder head 12, handles 18, 19, and a front portion 13. These parts are interconnected and symmetrically oriented relative to the longitudinal axis 24 of the cylinder bore 20. The cylinder bore 20 is extended rearwardly from an annular shoulder 21 through an enlarged bore 23. The cylinder bore 20 is also extended forwardly from an inner annular shoulder 25 through a forward bore 45. In front of the bore 45 the housing 11 is formed with a clamping portion 46 including an axial slot 47. The clamping portion 46 defines a further enlarged bore 48 which extends coaxially with the bore 45 and the cylinder bore 20.

In the bore 45 there is received an intermediate member in the form of a sleeve 17 which has an outer shoulder for abutting cooperation with the annular shoulder 25 and which extends sealingly into the cylinder bore 20. The sleeve 17 has an annular end surface 49 which faces the cylinder bore 20. The sleeve 17 is a part of the front section of the breaker housing 11 and serves as a guide sleeve for the impact receiving parts of the tool. The sleeve 17 has a central coaxial first bore 50 and an enlarged coaxial second bore 51 separated from the first bore 50 by an annular forwardly facing shoulder 52. The front portion 13 of the housing is a separate part which is formed with a tubular neck 55 to be inserted in the enlarged bore 48 of the clamping portion 46, thereby being axially located by the sleeve 17 which defines the axial position of the front portion 13 relative to the housing 11 via the annular shoulder 25.

A clamping bolt 56 extends transversely through a bore 57 in the clamping portion 46 and engages a tangential groove 58 in the neck portion 55 to lock positively the latter axially relative to the housing 11. By means of a nut (not shown) the clamping bolt 56 locks frictionally the neck 55 to the clamping portion 46 such that the front portion 13 and the sleeve 17 are rigidly secured to the housing 11.

In the bore 50 in the sleeve 17 there is sealingly guided an impact transferring anvil 14. The anvil 14 is formed with an impact receiving end surface 62 facing the cylinder bore 20 and an annular flange 53 which is guided in the enlarged second bore 51. The anvil 14 is rewardly displaceable by the neck portion 15 of the working implement 16, and the interengagement of the flange 53 and the annular shoulder 52 defines the rear working position of the anvil 14 relative to the housing 11. See FIG. 1B. In the working position of the anvil 14, the rear impact receiving end surfaces 62 is located substantially in level with or slightly below the rear end shoulder 49 of the sleeve 17. In a conventional way, the front portion 13 carries a releasable working implement retainer 60 which is engagable with the collar 61 of the working implement 16 while allowing a limited axial movement of the latter with the neck 15 guided in the neck portion 55 of the front portion 13. In its forwardmost position, the working implement 16 is blocked against further movement by the retainer 36 engaging the collar 61, which means that the anvil 14 remains in its extended position in which it abuts against the neck portion 55 of the front portion 13. The anvil 14 and the neck 15 forms the impact transferring means of the working implement 16.

According to an alternative design of the impact mechanism, the anvil 14 is omitted and the shank portion 15 of the working implement 16 is extended to reach the impact receiving position defined by the surface 62 of the anvil 14. The rearmost position of the shank portion 15 and, accordingly, the impact receiving surface 62 is determined by interengagement between the collar 61 of the working implement 16 and the front portion 13.

Figure 2:
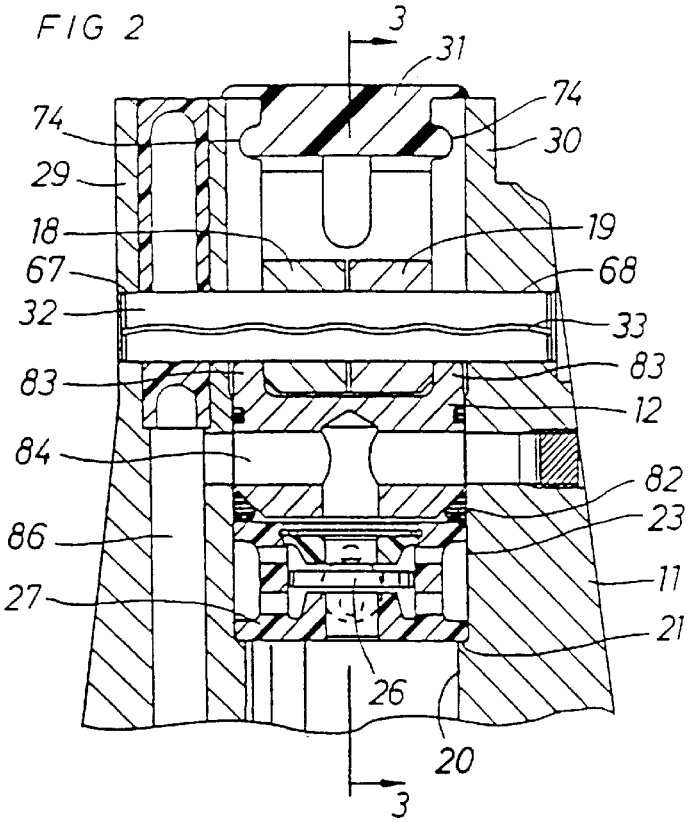
FIG. 2 shows on a larger scale a longitudinal section of the rear part of the breaker according to FIG 1A.
Figure 3:
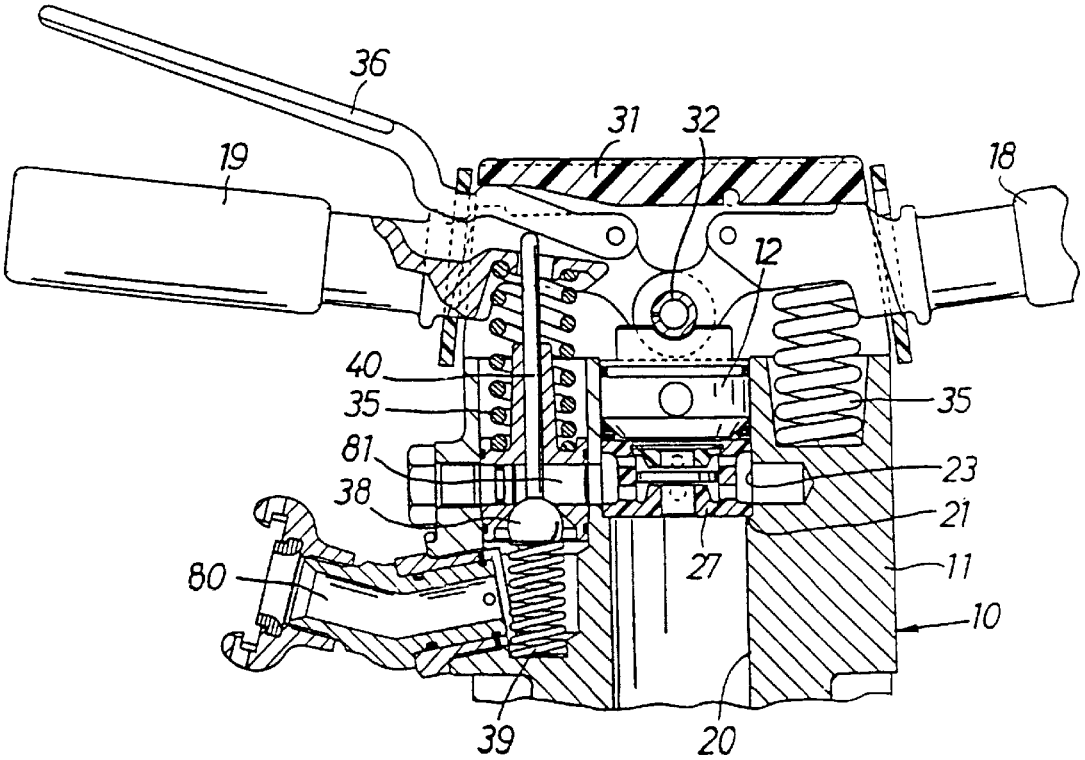
FIG. 3 shows on a somewhat smaller scale a section along line 3—3 in FIG. 2.

At its rear end, the housing 11 is formed with two side walls 29, 30, FIG. 2, which extend rearwardly beyond the cylinder head 12 and the central portions of the handles 18, 19. In opposite coaxial bores 67, 68 in the side walls 29, 30 there is inserted a wedge bolt 32 which comprises a cylindrical steel tube having an axially extending zigzag shaped slot 33 for obtaining radial compressability. Thanks to the zigzag shaped slot 33, the wedge bolt 32 gets a smoother outer surface without any straight cutting edges which could damage the bores 67, 68 at mounting. The wedge bolt 32 forms a mounting pivot for the central parts of the handles 18, 19, FIG. 3, thereby connecting the handles 18, 19 to the housing 11. Vibration damping pretensioned springs 35 are located between the housing 11 and each of the handles 18, 19 to bias the handles toward a rear end cover 31. This end cover 31 is formed of a plastic material and is secured in opposite grooves 74 in the side walls 29, 30.

Inside the cover 31, the handle 19 supports a pivot lever 36 which by means of a push rod 40 is arranged to control an air inlet valve 38. The latter is biased by a spring 39 toward closed position. By manipulating the lever 36, thereby activating the inlet valve 38, a connection between a pressure air inlet 80 and an inlet passage 81 in the housing 11 and the rear bore 23 of the cylinder bore 20 is controlled.

Figure 4:
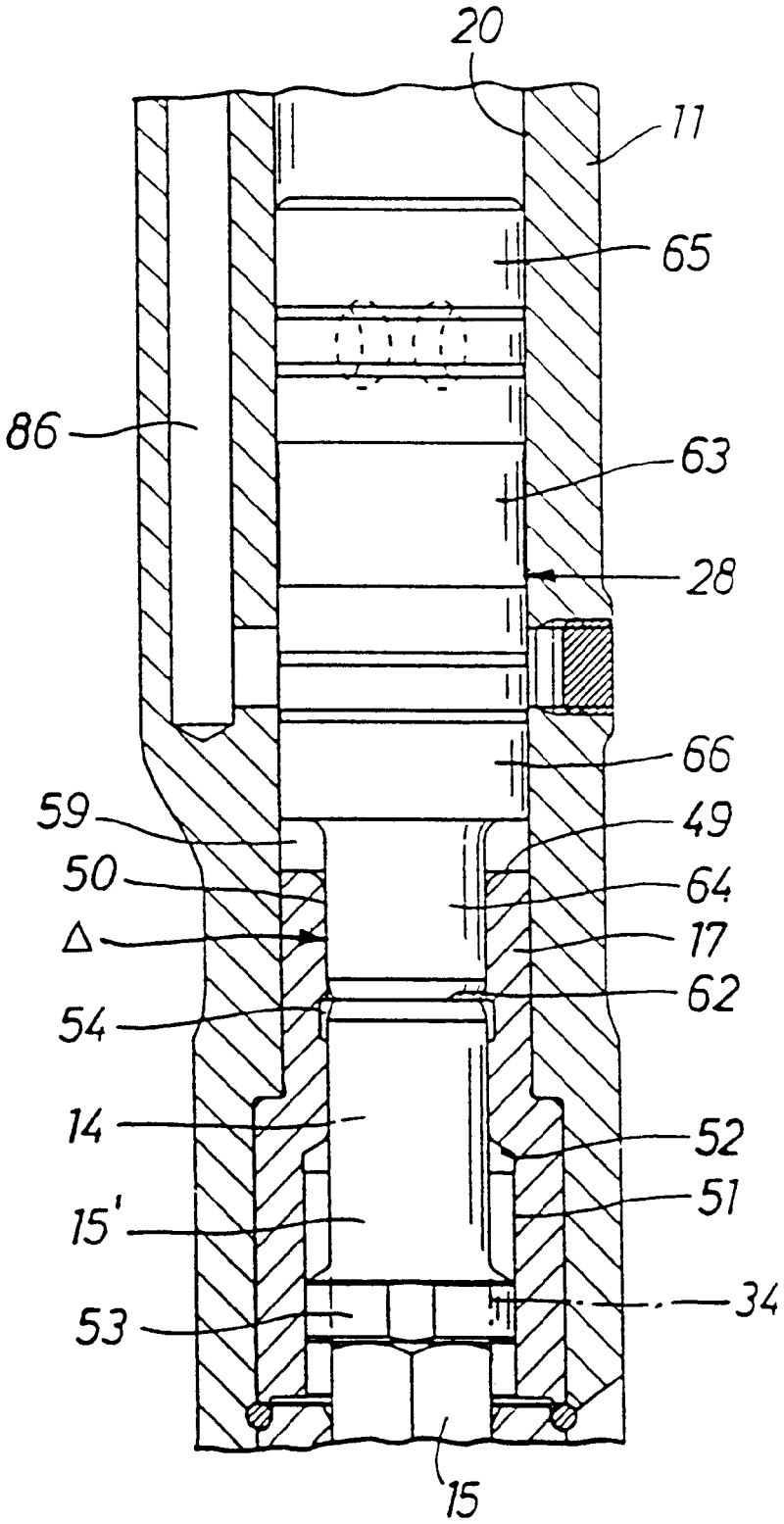
FIG. 4 shows on a larger scale a fractional view of FIG. 1B, but illustrates a different operating position of the impact generating parts.

Resting on the axial shoulder 21 in the enlarged bore 23, there is inserted a valve housing 27 of a distributing valve, FIGS. 2, 4. The cylinder head 12 comprises a plug of metal or a plastic material which is introduced into the enlarged bore 23 and abuts and locks axially the valve housing 27 via a seal ring 82. At its rear end the plug 12 is formed with two rearwardly extending heals 83 which are formed with indentations 79 and which are located on both sides of the handles 18, 19. The heals 83 rest against the wedge bolt 82 such that the plug 12 is axially locked in the bore 23. The plug 12 has a radially extending air distributing passage 84 which via a longitudinally extending feed passage 86 in the housing 11 communicates with a front end of the cylinder bore 20. The passage 84 is open toward the valve housing 27 via a central axially extending opening.

The valve housing 27 is formed in a plastic material, preferably acetal plastic (delrin), and comprises a rotationally symmetric and substantially cup-shaped main part having an outer circumferential groove 87 communicating with the air inlet passage 81 in the housing 11. In the valve housing 27, there is shiftably disposed a valve plate 26, also of a plastic material, for alternative cooperation with a forward valve seat 41 which is open to the cylinder bore 20 and a rear valve seat 42 which is open to the radial air passage 84 in the plug 12. The bottom 88 of the circumferential groove 87 is provided with radial openings 89 which are disposed in axially separated rows between which the valve plate 26 is shiftable. The rear valve seat 42, also formed in a plastic material such as acetal plastic, comprises a lid which is inserted in the valve housing 27 and locked by a lock ring 43. See FIG. 2.

In the cylinder bore 20, between the valve housing 27 and the end surface 49 of the sleeve 17, there is reciprocably guided a hammer piston 28. The latter is formed with a piston head 63 having a rear end portion 65 and a forward end portion 66 which are sealingly guided in the cylinder bore 20, and a piston neck 64 which is intended to deliver hammer blows onto the impact receiving surface 62 of the anvil 14.

The anvil 14 is sealingly guided in the cylinder bore extension 50 formed in the sleeve 17 and may occupy any axial operating position therein depending on the actual magnitude of the feeding or application force applied on the breaker handles 18, 19. If an extremely high feeding force were applied, the anvil 14 would occupy its rearmost position as illustrated in FIG. 1B. In such a case, the rear impact receiving end surface 62 of the anvil 14 would be flush with the shoulder 49 in the cylinder bore 20 and the stem portion 64 of the hammer piston 28 would not at all penetrate into the cylinder bore extension 50.

In the other extreme, the feeding force applied on the breaker housing 11 is negative, i.e. the housing 11 is lifted up in relation to the working implement 16. In such a case, which occurs rather frequently during operation of the breaker, the anvil 14 is displaced to its forwardmost position, thereby allowing the piston stem position 64 to penetrate by its full length into the cylinder bore extension 50.

In normal operating positions of the anvil 14, however, the rear end surface 62 is situated somewhere in front of the annular shoulder 49, which means that the piston stem 64 always penetrates to some extent into the cylinder bore extension 50. Since, accordingly, the piston stem 64 normally enters the cylinder bore extension 50 air volumes are entrapped both in the ring chamber 59 formed between the cylinder bore 20, the shoulder 49 and the piston stem 64, and in the cylindrical chamber formed between the piston stem 64 and the rear end surface 62 of the anvil 14 in the cylinder bore extension 50. The air volume in the ring chamber 59 has a very important purpose, namely to form a piston damping and energy absorbing air cushion to prevent the piston 28 from mechanically hitting against the shoulder 49 in cases of no load strokes i.e. when the feeding force is very low or negative.

In contrast thereto, the air volume entrapped between the piston stem 64 and the anvil 14 has a negative influence on the operation of the breaker. This is because this air volume acts as an energy absorbing cushion which prevents an efficient energy transfer from the piston 28 to the anvil 14.

The invention aims to solve these two problems, namely how to improve the efficiency of the impact damping annular air cushion entrapped in the ring chamber 59 and how to avoid the influence of the energy absorbing air volume entrapped in the cylinder bore extension 50.

The latter problem is dealt with by providing the sleeve 17 with an inner circumferential groove 54 located at a certain distance from the shoulder 49 which forms the rear end of the cylinder bore extension 50. This groove 54 forms an annular expansion volume by which the magnitude of the pressure peaks in the entrapped air volume are substantially reduced as is the damping effect.

The other problem together with the previously mentioned problem of how to avoid metallic contact between the piston stem 64 and the cylinder bore extension 50 are solved both by designing the hammer piston 28 so as to accomplish an accurate guidance of the hammer piston 28 in the cylinder bore 20 and minimize radial misalignment of the stem portion 64 in relation to the cyinder bore extension 50, and by arranging the radial plays between the different piston portions so as to enable an improved tightness of the annular air cushion chamber 59.

This is obtained by giving the piston head 63 a considerably larger axial extent than the piston stem 64, by forming the piston head 63 with two axially spaced end portions 65, 66 for sealing and guiding cooperation with the cylinder bore 20, and by providing a radial play between each one of these end portions 65, 66 and the cylinder bore 20 that is smaller than the radial play between the piston stem 64 and the cylinder bore extension 50. The piston head 63 should be at least three times longer than the stem 64.

By these measures, the guidance of the hammer piston 28 is very accurate and the play between the piston stem 64 and the cylinder bore extension 50 could be comparatively small, less than 0,05 mm, without risking metallic contact, which means that the annular air cushion chamber 59 is very tight and provides a very good energy absorption. Thereby, the breaker housing 11, hammer piston 28, bushing 17 and other parts are protected from damage at bottom strokes of the hammer piston 18 at no-load operation.

As the operator applies the impact breaker 10 against the working surface the working implement 16 as well as the anvil 14 are displaced rearwardly to their normal operating positions. (See FIG. 1B.) As the lever 36 is pressed down, air pressure will be supplied to the valve housing 27 from the air inlet 80, through the inlet valve 38 and the passage 81. By cooperating alternatively with the valve seats 41, 42, the valve plate 26 will distribute air pressure to the respective ends of cylinder bore 20, to thereby make the hammer piston 28 reciprocate in the cylinder bore 20 and deliver repetitive hammer blows on the anvil 14. During the reciprocation of the hammer piston 28, the respective parts of the cylinder chamber 20 are vented to the atmosphere through outlet openings 70, 71 which are located at different axial levels in the housing 11. The outlet openings 70 vent the rear part of the cylinder chamber 20 behind the hammer piston 28, while the openings 71 vent the forward part of the cylinder chamber 20 in front of the hammer piston 28.

We claim:

1. A pneumatic impact breaker comprising:

a housing with a cylinder bore;

a hammer piston reciprocable in said cylinder bore;

a rear cylinder head with an air distributing valve for directing motive pressure air to alternate ends of said hammer piston to thereby reciprocate said hammer piston in said cylinder bore;

a front portion attached to said housing and forming a guide and support for a working implement;

a forwardly directed cylinder bore extension which is coaxial with and which has a smaller diameter than said cylinder bore;

an annular shoulder separating said cylinder bore extension from said cylinder bore; and an anvil sealingly guided in said cylinder bore extension, said anvil having a rear end normally located within said cylinder bore extension and a forward end normally abutting a rear end of the working implement;

wherein said hammer piston includes a piston head for sealing and guiding cooperation with said cylinder bore, and a forwardly extending stem portion having a smaller diameter than said piston head and arranged to cyclically penetrate into said cylinder bore extension to deliver repeated impacts to said rear end of said anvil at reciprocation of said hammer piston, whereby said stem portion and said piston head together with said cylinder bore and said annular shoulder form an annular energy absorbing air cushion chamber;

wherein said piston head has an axial length that is at least three times an axial length of said stem portion;

wherein said piston head comprises two axially spaced end portions for guiding and sealing cooperation with said cylinder bore;

wherein a radial play between each one of said axially spaced said end portions and said cylinder bore is smaller than a radial play between said stem portion and said cylinder bore extension thereby enhancing the tightness of said annular energy absorbing air cushion chamber by aligning said stem portion with said cylinder bore extension; and wherein said cylinder bore extension comprises a circumferential groove located at a predetermined axial distance from said annular shoulder to form an annular expansion volume for air entranced between said anvil and said stem portion as said stem portion penetrates into said cylinder bore extension during impact strokes.

2. The impact breaker according to claim 1, wherein said cylinder bore extension comprises a sleeve extending into said cylinder bore, and said annular shoulder comprises a rear end surface of said sleeve.

3. The impact breaker according to claim 2, wherein an annular collar is provided at the forward end of said anvil, and said sleeve comprises an enlarged guide bore located coaxially with and in front of said cylinder bore extension to form a guide for said annular collar.

* * * * *